US009248679B1

(12) United States Patent
Aoi

(10) Patent No.: US 9,248,679 B1
(45) Date of Patent: Feb. 2, 2016

(54) RECORDING APPARATUS

(71) Applicant: OKI DATA INFOTECH CORPORATION, Chiba-shi, Chiba (JP)

(72) Inventor: Yoshihisa Aoi, Chiba (JP)

(73) Assignee: Oki Data Infotech Corporation, Chiba-shi, Chiba (JP)

( * ) Notice: Subject to any disclaimer, the term of this patent is extended or adjusted under 35 U.S.C. 154(b) by 0 days.

(21) Appl. No.: 14/435,838

(22) PCT Filed: Oct. 23, 2013

(86) PCT No.: PCT/JP2013/078653

§ 371 (c)(1),
(2) Date: Apr. 15, 2015

(87) PCT Pub. No.: WO2014/141520

PCT Pub. Date: Sep. 18, 2014

(30) Foreign Application Priority Data

Mar. 15, 2013 (JP) ..... 2013-053832

(51) Int. Cl.
*B41J 29/393* (2006.01)
*B41J 29/38* (2006.01)

(52) U.S. Cl.
CPC ..... *B41J 29/393* (2013.01)

(58) Field of Classification Search
CPC ..... B41J 29/393; B41J 2/2135; B41J 19/145; B41J 2/471
USPC ..... 347/14, 19
See application file for complete search history.

(56) References Cited

U.S. PATENT DOCUMENTS

2003/0016263 A1* 1/2003 Takahashi ..... B41J 2/125 347/19
2006/0158472 A1* 7/2006 Endo ..... B41J 11/0095 347/14
2013/0050324 A1* 2/2013 Uchida ..... B41J 2/2139 347/14

FOREIGN PATENT DOCUMENTS

JP 2012153021 8/2012

OTHER PUBLICATIONS

International Search Report mailed Dec. 3, 2013 issued in International Appln. No. PCT/JP2013/078653.

*Primary Examiner* — Jason Uhlenhake
(74) *Attorney, Agent, or Firm* — Muncy, Geissler, Olds & Lowe, P.C.

(57) ABSTRACT

When an inkjet printer ejects ink onto a recording medium on a go path and on a return path of a carriage, if ink cannot be ejected onto the same position on the go path and on the return path, image quality becomes poor. Test patterns with shifted ejection timing are hitherto recorded on the recording medium, and appropriate timing is input as a correction value. There is also an inkjet printer which automatically reads a test pattern, but the test pattern is recorded without consideration of a state of a head, and thus, accuracy is low. Therefore, a test pattern having a long period and a test pattern having a short period are recorded, and densities of the test patterns are read by a sensor. An extremum candidate is determined from the test pattern having a long period, and rough adjustment is made first. Then, in a region around the extremum, an extremum is determined from the test pattern having a short period. An extremum corresponding to a period to which the extrema of the two test patterns belong is set as a correction value. By determining ejection timing of the recording head using the correction value, an image in which dot deviation between the go path and the return path is inhibited can be recorded.

4 Claims, 8 Drawing Sheets

RECORDING APPARATUS

TECHNICAL FIELD

The present invention relates to a recording apparatus including an inkjet head mounted thereon for ejecting ink onto a recording medium.

BACKGROUND ART

An inkjet recording apparatus is widespread, which is configured to supply ink from an ink cartridge to an inkjet recording head and eject an ink droplet from the recording head onto a recording medium, to thereby produce a record of, for example, an image or a character.

Such an inkjet recording head is widely adopted not only for a small-format recording head used in a home, a small office, or the like, but also for a large-format recording head that can perform printing onto a large recording medium having a width of more than 1 m.

In such an inkjet recording apparatus, an inkjet recording head is mounted on a carriage configured to reciprocate over a recording medium in a width direction thereof, and ink is ejected onto the recording medium on a go path and on a return path. A position of the carriage is obtained by reading a linear scale arranged along a direction of movement of the carriage by a sensor mounted on the carriage. In general, a device referred to as a linear encoder is used.

Ink is ejected on a go path and on a return path based on the position of the carriage, but the positions of the carriage and the recording head mounted on the carriage subtly deviate from target positions due to an error at the time of installation, a difference in thickness of the recording medium used, or the like. Therefore, it is necessary to correct the deviation. A test pattern is printed on a recording medium, an amount of deviation is determined from the test pattern, and a correction value corresponding to the amount of deviation is input to the recording apparatus. Based on the input correction, the position at which ink is to be ejected is changed to eliminate the deviation.

Further, for example, in Patent Application Publication NO. JP 2012-153021 A, there is disclosed a technology of recording such a test pattern to automatically read the test pattern, thereby obtaining an optimum amount of correction.

CITATION LIST

Patent Literature

[Patent Literature 1] JP 2012-153021 A

SUMMARY OF INVENTION

Technical Problem

However, the related art involves recording patterns having different periodicity at a time, and thus requires the condition that all nozzles for ejecting ink have the same characteristics. Specifically, when nozzles for recording patterns having different periodicity have different ejection performance, for example, when a certain nozzle has an ejection trajectory which is skewed to a small extent, and a position of a dot formed thereby on a recording medium is thus different from those formed by other nozzles, a correct pattern cannot be recorded. Consequently, a value obtained by reading the pattern also has an error.

Further, when reading is optically carried out, the reading is carried out while the carriage is moving, and in addition, a surface of the recording medium is uneven to some extent. Thus, an error in reading is included. Due to accumulation of such errors, an incorrect value is finally determined by computation in some cases. Therefore, when ejection timing between a go path and a return path are remarkably different from each other, an image becomes blurred because of deviation of dot landing and the quality of the image to be formed becomes poor, which is a problem.

Solution to Problem

Accordingly, it is an object of the present invention to provide a recording apparatus which inhibits a detection error in a correcting step of correcting ejection timing on a go path and on a return path, to thereby perform a correction with a more accurate value.

The recording apparatus according to one embodiment of the present invention includes: a recording apparatus, including: a recording head for ejecting ink onto a recording medium; conveying means for conveying the recording medium; a carriage for mounting the recording head thereon and reciprocating the recording head for scanning in a direction intersecting a conveying direction of the recording medium; a platen for supporting the recording medium, which is arranged at a position opposed to the reciprocatingly-scanned recording head along a scanning direction of the recording head; and a sensor mounted on the carriage, for detecting a density of an image recorded on the recording medium, the recording apparatus being configured to: record a test pattern on the recording medium in which a position of a dot formed on the recording medium on a go path and a position of a dot formed on the recording medium on a return path in the reciprocatingly-scanning of the recording head are relatively changed by a resolution unit in the scanning direction, read a density of the test pattern by the sensor; compute ejection timing at which the dots are formed on the recording medium at the same position on the go path and on the return path; and record an image based on the computed ejection timing, in which the test pattern is obtained by recording repeatedly alternately a recorded portion in which the dot is recorded and an unrecorded portion in which no dot is recorded a plurality of times in the scanning direction, and in which the recording apparatus further includes: storing means for storing the test pattern including a first test pattern and a second test pattern, the first test pattern being longer than the second test pattern in a period formed of the recorded portion and the unrecorded portion; and control means for: obtaining the first test pattern from the test pattern stored in the storing means to record the first test pattern on the recording medium, detecting a density of the recorded first test pattern by the sensor, and computing a position of the dot formed on the recording medium at which the density is lowest; and obtaining the second test pattern from the test pattern stored in the storing means to record on the recording medium the second test pattern in which the position of the dot formed on the recording medium is relatively changed by the resolution unit by using, as a center, the position of the dot formed on the recording medium at which the density is lowest, which is determined by the computation, detecting a density of the recorded second test pattern by the sensor, computing the position of the dot formed on the recording medium at which the density is lowest, and computing the ejection timing based on the position of the dot formed on the recording medium at which the density is lowest, which is obtained based on the second test pattern.

Advantageous Effects of Invention

By recording different test patterns twice on the recording medium on the go path and on the return path of the carriage and by correctly reading the test patterns, timing of ejection from the recording head may be corrected so that ink may be ejected onto the same position on the go path and on the return path of the carriage. Lowered image quality due to difference in ejection timing between the go path and the return path can be inhibited.

DESCRIPTION OF EMBODIMENT

In the following, an embodiment of the present invention is described with reference to the drawings.

Figure 8:
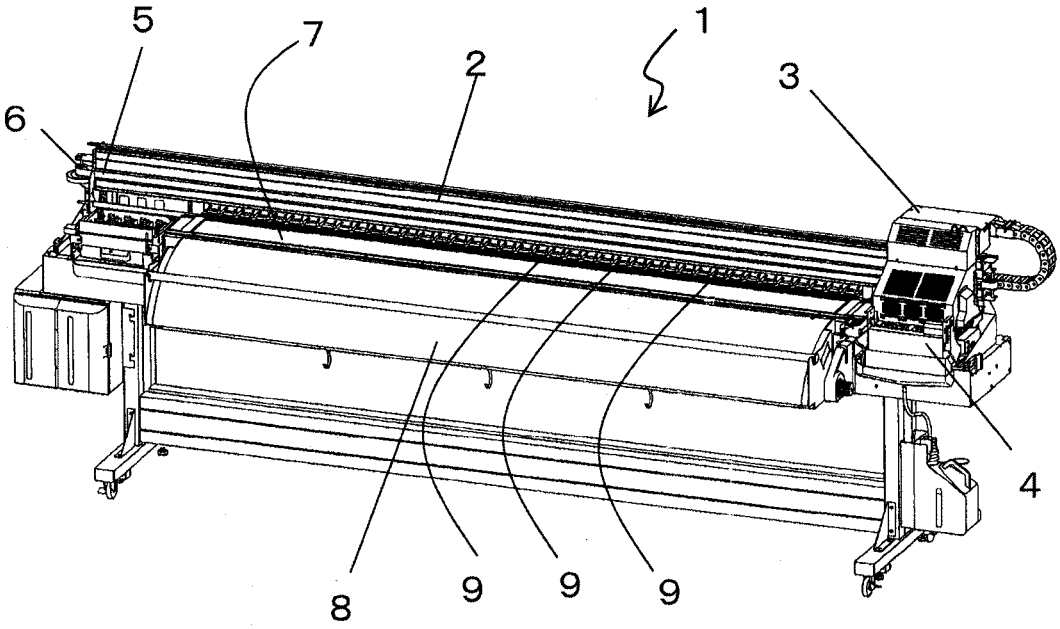
FIG. 8 is a schematic view illustrating the entire recording apparatus.

First, an entire inkjet printer 1 which is a recording apparatus of this embodiment is described with reference to FIG. 8. The inkjet printer 1 includes a rail 2 which linearly extends in a width direction thereof. A carriage 3 reciprocates along the rail 2. Inkjet recording heads are mounted on the carriage 3. In order to perform color printing, the recording heads are mounted on the carriage 3 correspondingly to four colors of ink, i.e., yellow, cyan, magenta, and black, and in addition, three colors of ink, i.e., light cyan, light magenta, and gray, which respectively correspond to light colors of cyan, magenta, and black each having reduced concentration of pigment. By using light color ink, color reproduction can be improved to improve quality of an image to be recorded. A cap 4 hermetically seals the recording heads so as not to be dried and periodically sucks ink from the inkjet heads for maintenance. Conveying means for conveying a recording medium such as paper or a plastic film includes a large number of conveying rollers 9 arranged along the rail 2. By rotating the conveying rollers 9, the recording medium is conveyed.

The carriage 3 is connected to an endless belt 5. The endless belt 5 is connected to a motor 6. The endless belt 5 is wound around a pulley arranged at an end of the inkjet printer 1. By driving the motor 6, the endless belt 5 moves, and at the same time, the carriage 3 moves.

A platen 7 is a flat plate arranged along the rail 2. A plurality of suction holes are formed in a surface of the platen 7. The recording medium which is being conveyed can be fixed by sucking through the suction holes. A downstream guide 8 is arranged on a downstream side of the platen 7 in a recording medium conveying direction. The downstream guide 8 guides the conveyed recording medium. Further, an upstream guide is arranged on an upstream side of the platen 7 in the recording medium conveying direction. The platen 7, the downstream guide 8, and the upstream guide are each arranged with a heater which enables heating thereof. This heating heats the conveyed recording medium to an appropriate temperature, to thereby promote fixing of the ink.

The platen 7 is a flat plate made of aluminum. The surface of the flat plate made of aluminum is flat, and the suction holes are formed therein. A groove is formed on a rear side of the flat plate, and a heater wire is embedded in the groove for heating the platen 7. Further, the downstream guide 8 and the upstream guide are formed by bending a plate made of iron, and each include a heater wire arranged on a rear side thereof which is covered with and fixed by an aluminum sheet.

Figure 1:
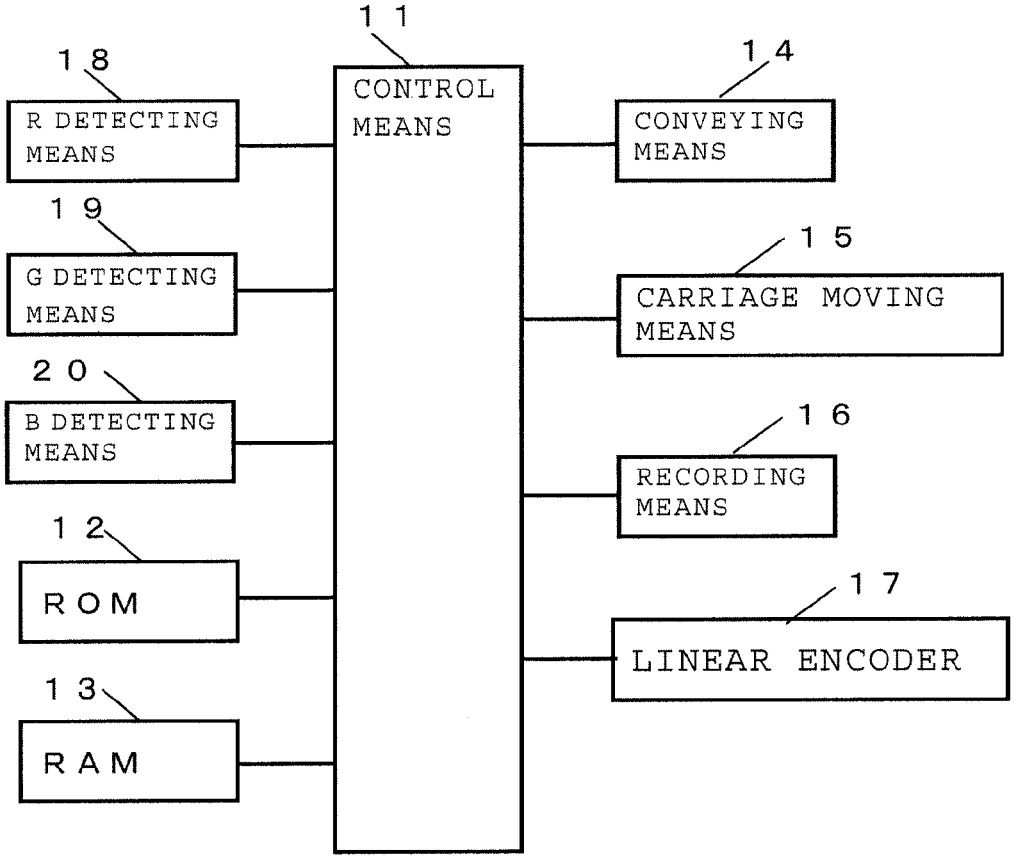
FIG. 1 is a block diagram of a recording apparatus.

FIG. 1 is a block diagram of a recording apparatus. Control means 11 is control means which operates in accordance with a program stored in advance and performs various kinds of control of the entire recording apparatus. A ROM 12 is a nonvolatile memory, and is a memory for storing information such as a program and initial set values of the control means 11. A RAM 13 is a working memory used for computation by the control means 11 or a memory for storing temporary information.

Conveying means 14 includes the conveying rollers 9, a motor for driving the conveying rollers 9, and a drive circuit for driving the motor, and is means for conveying the recording medium. The conveying roller 9 includes a pair of a drive roller and a pinch roller, and the drive roller is rotated by the motor. The pinch roller is pressed against the drive roller and is rotated in accordance therewith. The recording medium is nipped between the drive roller and the pinch roller to be conveyed. The drive circuit of the conveying means 14 is controlled by the control means 11 so that the motor is driven to rotate the conveying rollers 9, to thereby convey the recording medium.

Carriage moving means 15 moves the carriage 3, which is fixed to the endless belt 5, along the rail 2. The motor 6 for rotating the endless belt 5 is driven by a drive circuit included in the carriage moving means 15. The drive circuit is controlled by the control means 11. The carriage 3 moves along the rail 2 in accordance with a program for the control means 11.

Recording means 16 includes recording heads corresponding to ink colors. The recording heads eject ink based on a drive signal from a head drive circuit. The head drive circuit operates based on a control signal from the control means 11.

A linear encoder 17 optically detects a division of a linear scale linearly arranged along a moving direction of the carriage 3. The linear encoder 17 operates based on a control signal from the control means 11, performs analog-to-digital conversion on a result of the detection, and outputs the signal to the control means 11. By counting the signal, the control means 11 can specify a position of the carriage 3 to obtain the position, and can perform control in accordance with the position.

Positions of the respective recording heads mounted on the carriage 3 can be specified in advance, and are stored in the ROM 12. By driving the recording heads to eject ink in accordance with the position of the carriage 3, that is, the positions of the recording heads, a desired image can be recorded.

Test patterns are stored in advance in the ROM 12. There are a plurality of test patterns in accordance with the circumstances. In accordance with the circumstances, the control means 11 reads and uses a necessary test pattern from the plurality of test patterns.

R detecting means 18 is an optical sensor which emits red light and detects reflection thereof. G detecting means 19 is an optical sensor which emits green light and detects reflection thereof. B detecting means 20 is an optical sensor which emits blue light and detects reflection thereof. Those types of the detecting means detect a density of an image recorded on the recording medium in detection ranges of the respective detecting means, and output results of the detection to the control means 11. The control means 11 performs computations based on the results of detection, and changes ejection timing of the recording heads to improve quality of an image to be recorded.

Figure 2:
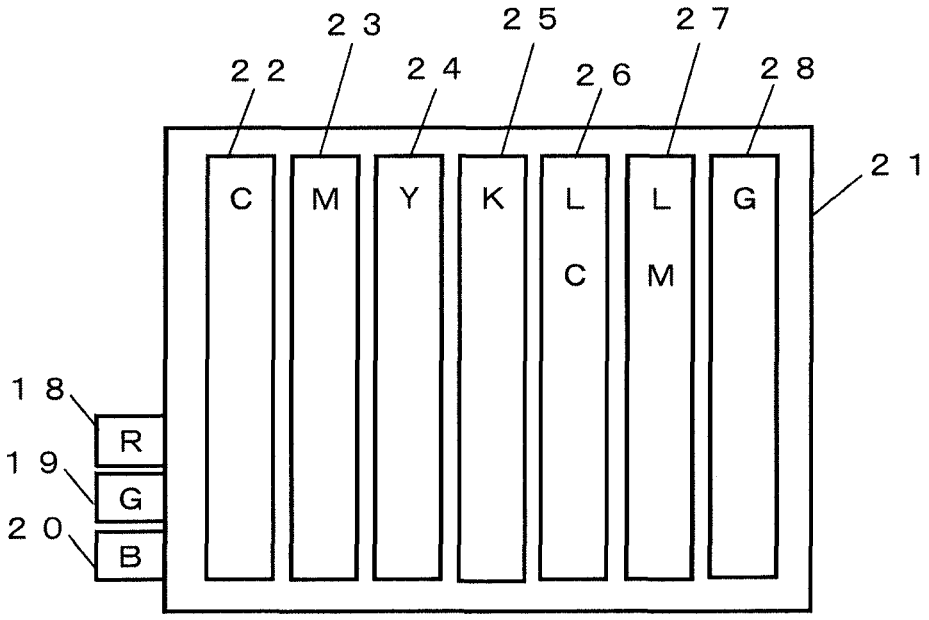
FIG. 2 is a schematic view of a layout of recording heads and detection sensors mounted on a carriage.

FIG. 2 is a schematic view of a layout of the recording heads and the detection sensors mounted on the carriage. A carriage base 21 is arranged on the carriage 3 at a position opposed to the platen 7. The recording heads are fixed to the carriage base 21. The recording heads fixed to the carriage base 21 are seven recording heads respectively corresponding to cyan, magenta, yellow, black, light cyan, light magenta, and gray, i.e., a recording head 22 for cyan, a recording head 23 for magenta, a recording head 24 for yellow, a recording head 25 for black, a recording head 26 for light cyan, a recording head 27 for light magenta, and a recording head 28 for gray. The R detecting means 18 detects cyan and light cyan. Because the two colors use the same pigment as the coloring material with different concentrations, the same detecting means can detect the two colors. The same holds true for the G detecting means 19 for magenta and light magenta. The B detecting means 20 detects yellow. Further, black and gray correspond to light sources to which the B detecting means 20 reacts well, and thus, the B detecting means 20 is used for detecting black and gray. The same pigment is used also for black and gray as the coloring material.

Figure 3:
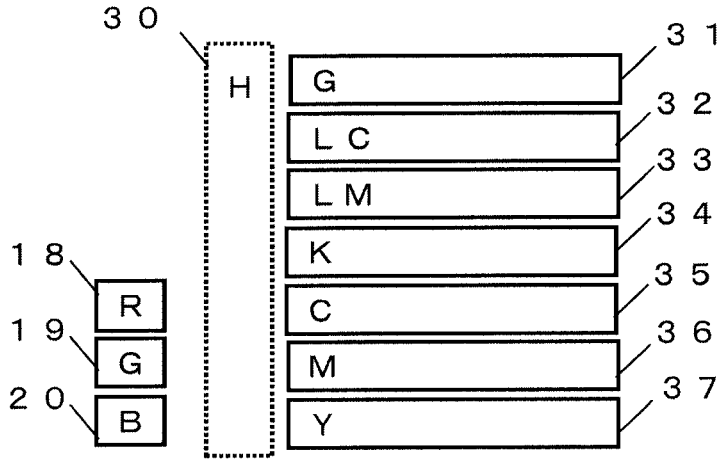
FIG. 3 is an explanatory view of a first exemplary layout of recording positions of ink ejected from the recording heads.

FIG. 3 is an explanatory view of a first exemplary layout of recording positions of ink ejected from the recording heads and the sensors. For the sake of simplicity of description, a position 30 of the recording heads is used in the description. The respective recording heads are fixed to the carriage base 21 so that widths and positions of record are the same when the recording heads are moved in a scanning direction for recording. With regard to the test patterns to be recorded on the recording medium, patterns of the respective colors are recorded in a direction perpendicular to a longitudinal direction of the position 30 of the recording heads. In accordance with the layout of the detecting means, a yellow pattern 37, a magenta pattern 36, a cyan pattern 35, a black pattern 34, a light magenta pattern 33, a light cyan pattern 32, and a gray pattern 31 are printed in parallel with one another. The widths of those printings are wider than the detection ranges of the detecting means. The three detecting means are used and the patterns of all the colors are checked with three times of scanning. The pattern recording is completed by one reciprocation. In other words, the check is completed with five times of scanning. When rough adjustment and fine adjustment are made, scanning needs to be performed twice as much as that in this case.

Figure 4:
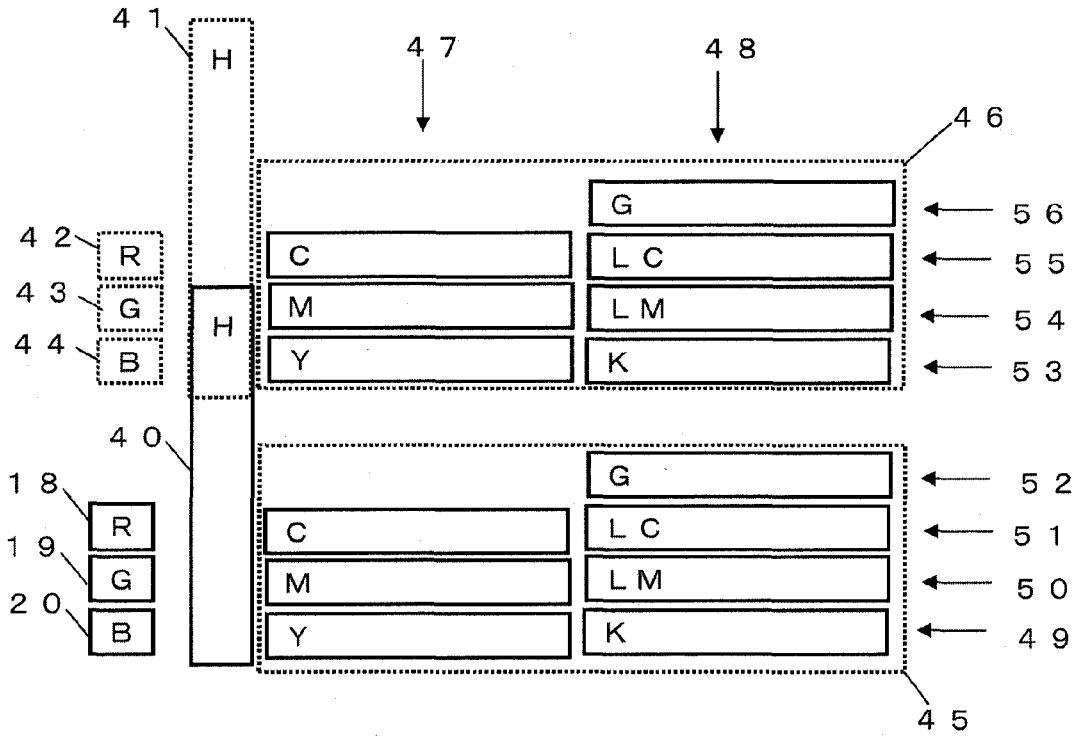
FIG. 4 is an explanatory view of a second exemplary layout of recording positions of ink ejected from the recording heads.

FIG. 4 is an explanatory view of a second exemplary layout of recording positions of ink ejected from the recording heads and the sensors. For the sake of simplicity of description, positions 40 and 41 of the recording heads are used in the description. The respective recording heads are fixed to the carriage base 21 so that widths and positions of record are the same when the recording heads are moved in a scanning direction for recording. With regard to the test patterns to be recorded on the recording medium, patterns of the respective colors are recorded in a direction perpendicular to a longitudinal direction of the position 40 of the recording heads. In accordance with the layout of the detecting means, a yellow pattern and black pattern line 49, a magenta pattern and light magenta pattern line 50, a cyan pattern and light cyan pattern line 51, and a gray pattern line 52 are recorded by one reciprocation of scanning. Two times of scanning are necessary for checking by the detecting means. Next, the recording medium is conveyed, and a position 42 of the R detecting means, a position 43 of the G detecting means, and a position 44 of the B detecting means that are represented by the dotted lines, and a yellow pattern and black pattern line 53, a magenta pattern and light magenta pattern line 54, a cyan pattern and light cyan pattern line 55, and a gray pattern line 56 are recorded by one reciprocation of scanning. In other words, a test pattern 45 for rough adjustment and a test pattern 46 for fine adjustment can be printed by printing eight lines, and thus, the recording medium on which the test patterns are to be printed can be saved more.

Here, when the test patterns are printed, with regard to ink of light colors, in this case, ink of light cyan, light magenta, and gray, the concentrations of the pigments are about half as low as the concentrations of the pigments of ink of cyan, magenta, and black, respectively. Dots formed on the recording medium are in lighter colors, and thus, a detection error may be caused. Therefore, with regard to ink of those light colors, dots are further formed at the same positions on a go path and on a return path. Specifically, one pattern may be recorded by two reciprocations. This can prevent a detection error due to the light colors of the dots recorded.

Further, by further recording the gray pattern line in the yellow pattern and black pattern line 49, densities of the seven colors can be detected with scanning once.

Figure 5:
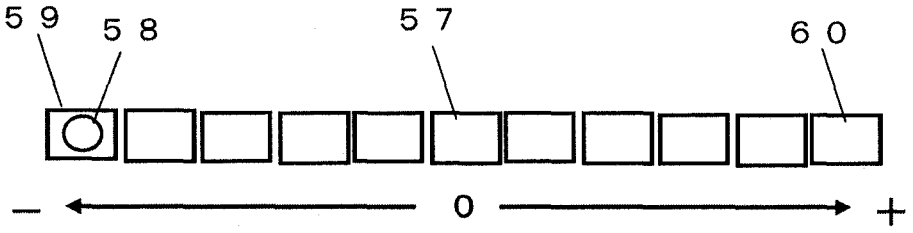
FIG. 5 is an explanatory view of test patterns and a detection range by detecting means.

FIG. 5 is an explanatory view of the test patterns and a detection range by the detecting means. The test pattern is first recorded based on the position of the carriage 3 obtained by the linear encoder 17. However, a dot on a go path and a dot on a return path do not necessarily match with each other due to a mechanical error or the like. Therefore, it is necessary to print the test pattern to determine a position at which the dots match with each other. Specifically, a first test pattern is printed in which printing on a go path and printing on a return path are relatively shifted by using, as a center of the shift, a position at which a dot on the go path and a dot on the return path are supposed to match with each other based on the position of the carriage 3 obtained by the linear encoder 17. From this, a position at which the dots match with each other is roughly determined. Then, a second test pattern is printed in which printing on the go path and printing on the return path are relatively shifted by using, as a center of the shift, the position at which the dots match with each other determined by the first test pattern. From this, the position at which the dots match with each other is finely determined.

The test pattern is recorded first on the go path as a basic pattern. Then, on the return path, recording is performed under a state in which ejection timing is subtly shifted. With regard to a shift method, patterns are printed which are incremented on a plus side and a minus side by a recordable smallest resolution unit with respect to a position 57 which is assumed to be the center and at which an amount of shift is zero. In the figure, a test pattern 60 and a test pattern 59 are printed. In the test pattern 60, dots on the return path are shifted from those on the go path by +1 to +5 dots with respect to the position 57 assumed to be the center and at which the amount of shift is zero. In the test pattern 59, dots on the return path are shifted from those on the go path by −1 to −5 dots with respect to the position 57. The test patterns are printed so that a detection range 58 of the detecting means does not exceed the test patterns. The detection range of the detecting means has the same size for all the colors.

Figure 6A:
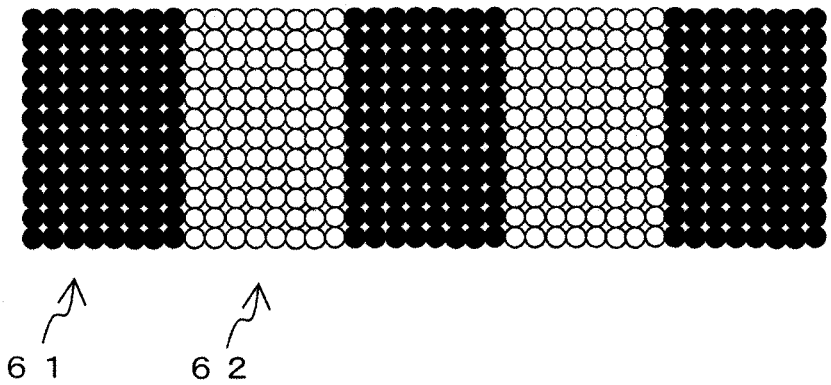
FIG. 6 (*a*) is an explanatory view of a first test pattern, and FIG. 6(*b*) is an explanatory view of a second test pattern.
Figure 6B:
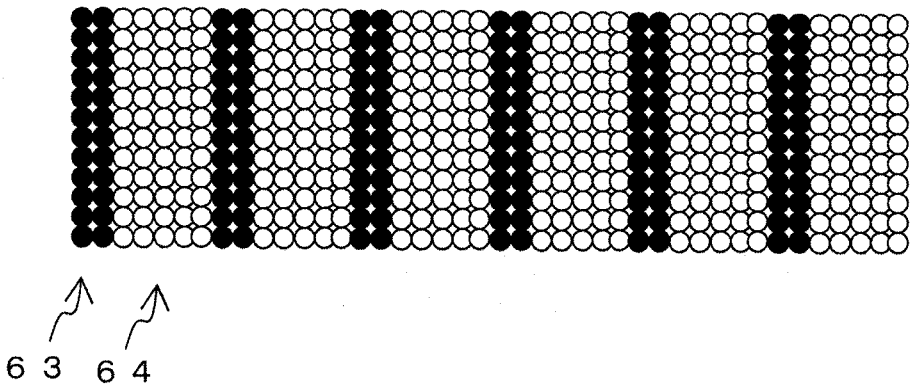

FIG. 6(*a*) is an explanatory view of the first test pattern, and FIG. 6(*b*) is an explanatory view of the second test pattern. In the first test pattern, ejected portions 61 and non-ejected portions 62 are alternately arranged. This pattern is shifted between the go path and the return path with regard to the temporary center value and is printed as described with reference to FIG. 5. By setting a width of the test pattern in the scanning direction to be large as in the first test pattern, detection accuracy becomes low, but a detection result having a long period can be obtained. The first test pattern having a long detection period is first printed and detected to determine a temporary set value of a rough adjustment. Then, using the second test pattern in which the temporary set value is the center to be printed next, a finely adjusted final set value is determined.

In the second test pattern, ejected portions 63 and non-ejected portions 64 are alternately arranged. As described with reference to FIG. 5, this pattern is shifted between the go path and the return path with regard to the temporary center value and is printed. By setting a width of the test pattern in the scanning direction to be small as in the second test pattern, detection accuracy becomes high, but a detection result having a short period can be obtained. This pattern is used to determine the finely adjusted final set value.

In the first test pattern, eight lines of dots are formed and eight lines of dots are unformed in the scanning direction. This is repeated a plurality of times. In the second test pattern, two lines of dots are formed and five lines of dots are unformed in the scanning direction. This is repeated a plurality of times. The first test pattern has a long period, and the second test pattern has a short period.

Figure 7:
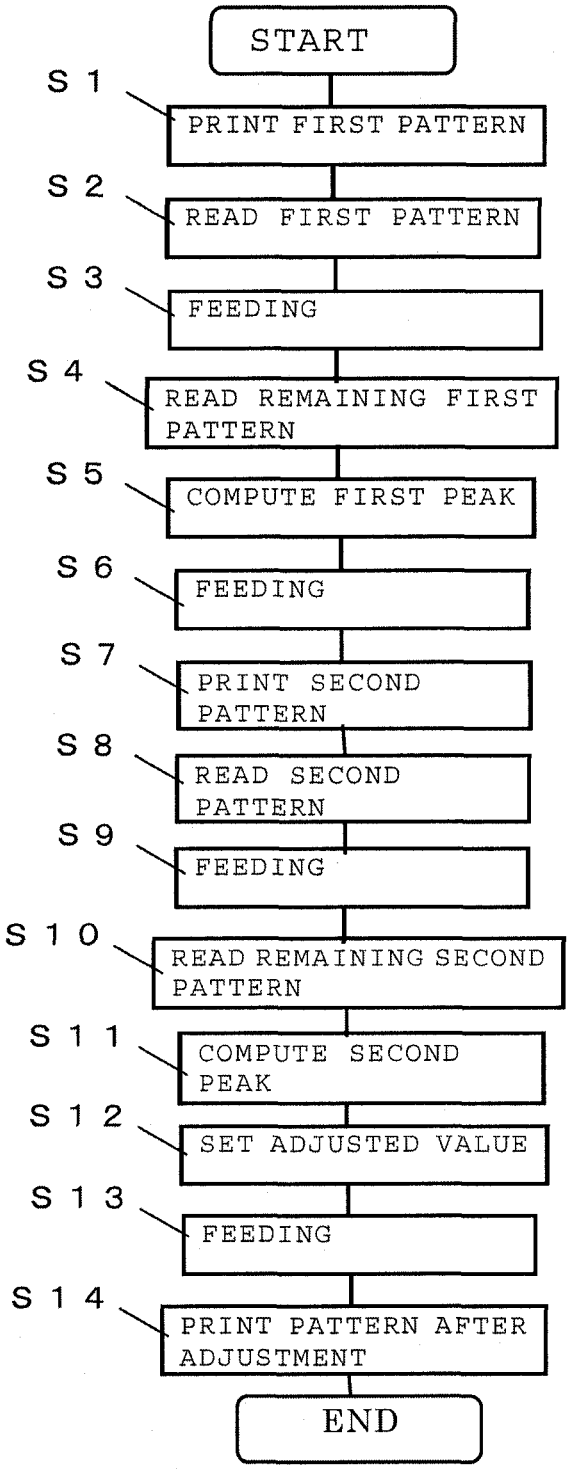
FIG. 7 is a flow chart illustrating recording of the test patterns and operation of detection thereof.

FIG. 7 is a flow chart illustrating recording of the test patterns and operation of the detection thereof.

In Step S1, the first test pattern is printed. This test pattern is a pattern for rough adjustment. Then, in Step S2, the density of the first test pattern is detected by the detecting means. The detection is carried out a plurality of times with regard to the respective patterns in which the amount of shift is changed, and an average value thereof is computed to be used as the density of the test pattern. The results of the computation are stored in the RAM 13 in relation to the respective patterns in which the amount of shift is changed.

Then, in Step S3, the recording medium is fed to a position for the test pattern of a remaining ink color. Then, in Step S4, similarly to Step S2, the densities of the respective patterns are detected to be stored in the RAM 13. If the detection is not completed, in Step S3 and Step S4, all the patterns for rough adjustment are detected.

Then, in Step S5, data stored in the RAM 13 with regard to the respective colors and the respective amounts of shift is computed. In this computation, a curve is estimated by least squares or the like. If positions on the go path and on the return path match with each other, the dots overlap with each other. An ideal position is such a position at which the dots completely overlap with each other and the density becomes the lowest. As the amount of shift becomes larger, the density becomes higher. The density is changed in accordance with the amount of deviation. Depending on the pattern, if the amount of the shift equals one period, the dots overlap with each other again. However, by using a pattern having a long period, this phenomenon is prevented. A peak at the lowest density in the estimated curve is determined, and an amount of shift of a smallest resolution unit which can control recording in the conveying direction nearest to the peak is regarded as the temporary set value of the rough adjustment.

Then, in Step S6, the recording medium is fed to a position at which recording is not performed as yet.

Then, in Step S7, the second test pattern is printed. This test pattern is a pattern for fine adjustment. Then, in Step S8, the density of the second test pattern is detected by the detecting means. The detection is carried out a plurality of times with regard to the respective patterns in which the amount of shift is changed, and an average value thereof is computed to be used as the density of the test pattern. The results of the computation are stored in the RAM 13 in relation to the respective patterns in which the amount of shift is changed.

Then, in Step S9, the recording medium is fed to a position for the test pattern of a remaining ink color. Then, in Step S10, similarly to Step S8, the densities of the respective patterns are detected to be stored in the RAM 13. If the detection is not completed, in Step S9 and Step S10, all the patterns for fine adjustment are detected.

Then, in Step S11, data stored in the RAM 13 with regard to the respective colors and the respective amounts of shift is computed. In this computation, a curve is estimated by least squares or the like. If positions on the go path and on the return path match with each other, the dots overlap with each other. An ideal position is such a position at which the dots completely match with each other and the density becomes the lowest. As the amount of shift becomes larger, the density becomes higher. The density is changed in accordance with the amount of shift. A peak at the lowest density in the estimated curve is determined, and an amount of shift of a smallest resolution unit which can control recording in the conveying direction nearest to the peak is regarded as the temporary set value of the fine adjustment.

Then, in Step S12, the final set value is set so as to be usable in printing as a correction value with which a dot position on a go path and a dot position on a return path match with each other.

Then, in Step S13, the recording medium is fed and another unused recording medium is set on the platen.

Then, in Step S14, test patterns of the respective colors are printed using the final set value. Together with this, the value is printed.

The test patterns are printed with the amount of shift of the smallest resolution unit which can control recording in the scanning direction, and the final set value is determined by the smallest resolution unit, to thereby print a test pattern for confirmation. When a user sees the test pattern and wants to make a correction, a recorrected value may be input via an operation panel, and the recorrected value may be set as the final set value.

INDUSTRIAL APPLICABILITY

The present invention may be used for an inkjet printer.

REFERENCE SIGNS LIST

1 inkjet printer
2 rail
3 carriage
4 cap
5 endless belt
6 motor
7 platen
8 downstream guide
9 conveying roller

11 control means 11
12 ROM
13 RAM
16 recording means
17 linear encoder
18 R detecting means
19 G detecting means
20 B detecting means

The invention claimed is:

1. A recording apparatus, comprising:

a recording head for ejecting ink onto a recording medium;

conveying means for conveying the recording medium;

a carriage for mounting the recording head thereon and reciprocating the recording head for scanning in a direction intersecting a conveying direction of the recording medium;

a platen for supporting the recording medium, which is arranged at a position opposed to the reciprocatingly-scanned recording head along a scanning direction of the recording head; and a sensor mounted on the carriage, for detecting a density of an image recorded on the recording medium, the recording apparatus being configured to:

record a test pattern on the recording medium in which a position of a dot formed on the recording medium on a go path and a position of a dot formed on the recording medium on a return path in the reciprocatingly-scanning of the recording head are relatively changed by a resolution unit in the scanning direction, read a density of the test pattern by the sensor;

compute ejection timing at which the dots are formed on the recording medium at the same position on the go path and on the return path; and record an image based on the computed ejection timing, wherein the test pattern is obtained by recording repeatedly alternately a recorded portion in which the dot is recorded and an unrecorded portion in which no dot is recorded a plurality of times in the scanning direction, and wherein the recording apparatus further comprises:

storing means for storing the test pattern comprising a first test pattern and a second test pattern, the first test pattern being longer than the second test pattern in a period formed of the recorded portion and the unrecorded portion; and control means for:

obtaining the first test pattern from the test pattern stored in the storing means to record the first test pattern on the recording medium, detecting a density of the recorded first test pattern by the sensor, and computing a position of the dot formed on the recording medium at which the density is lowest; and obtaining the second test pattern from the test pattern stored in the storing means to record on the recording medium the second test pattern in which the position of the dot formed on the recording medium is relatively changed by the resolution unit by using, as a center, the position of the dot formed on the recording medium at which the density is lowest, which is determined by the computation, detecting a density of the recorded second test pattern by the sensor, computing the position of the dot formed on the recording medium at which the density is lowest, and computing the ejection timing based on the position of the dot formed on the recording medium at which the density is lowest, which is obtained based on the second test pattern.

2. A recording apparatus according to claim 1, wherein the sensor carries out detection a plurality of times with regard to respective patterns in which the position of the test pattern is relatively changed, and wherein an average value of detected values obtained by the detection is set as a value of the density.

3. A recording apparatus according to claim 1, wherein the test pattern is recorded for each color of the ink, wherein the sensor is arranged for each light source corresponding to at least the each color of the ink, and wherein the light source comprises a blue LED for a coloring material of black of the ink, a red LED for a coloring material of cyan of the ink, a green LED for a coloring material of magenta of the ink, and a blue LED for a coloring material of yellow of the ink.

4. A recording apparatus according to claim 1, wherein the sensor comprises at least three sensors arranged along the conveying direction, wherein, when the first test pattern is recorded, the first test patterns with ink colors using the coloring materials corresponding to the same light source are recorded in one line along the scanning direction, and wherein, when the second test pattern is recorded, the second test patterns with ink colors using the coloring materials corresponding to the same light source are recorded in one line along the scanning direction.

* * * * *